US005239784A

United States Patent [19]

Stanfield

[11] Patent Number: 5,239,784

[45] Date of Patent: Aug. 31, 1993

[54] CAVITIED ABRADING DEVICE WITH SMOOTH LANDS AREA AND LAYERED GRIT

[75] Inventor: Charles K. Stanfield, Crete, Ill.

[73] Assignee: B & J Manufacturing Company, Glenwood, Ill.

[21] Appl. No.: 825,972

[22] Filed: Jan. 27, 1992

Related U.S. Application Data

[63] Continuation-in-part of Ser. No. 511,393, Apr. 18, 1990, abandoned.

[51] Int. Cl.[5] ..... B24D 7/00

[52] U.S. Cl. ..... 51/209 R; 51/204; 51/209 DL; 51/295

[58] Field of Search ..... 51/206 R, 209 R, 206 P, 51/204, 398, 295, 209 DL

[56] References Cited

U.S. PATENT DOCUMENTS

| | | | |
|---|---|---|---|
| 2,858,256 | 10/1958 | Fanhoe . | |
| 2,904,418 | 9/1959 | Fanhoe . | |
| 3,048,482 | 8/1962 | Hurst . | |
| 3,248,189 | 4/1966 | Harris, Jr. . | |
| 3,650,714 | 3/1972 | Farkas . | |
| 3,918,217 | 11/1975 | Oliver | 51/295 |
| 4,821,461 | 4/1989 | Holmstrand | 51/209 DL |

*Primary Examiner*—D. S. Meislin
*Attorney, Agent, or Firm*—Niro, Scavone, Haller & Niro

[57] ABSTRACT

An improved abrading device made with predetermined cavities. In this device, metal grit is magnetically positioned and then brazed on a metal surface to form a generally uniform distribution of the metal grit on the land area and not on the cavities of the metal surface.

3 Claims, 2 Drawing Sheets

Fig. 1
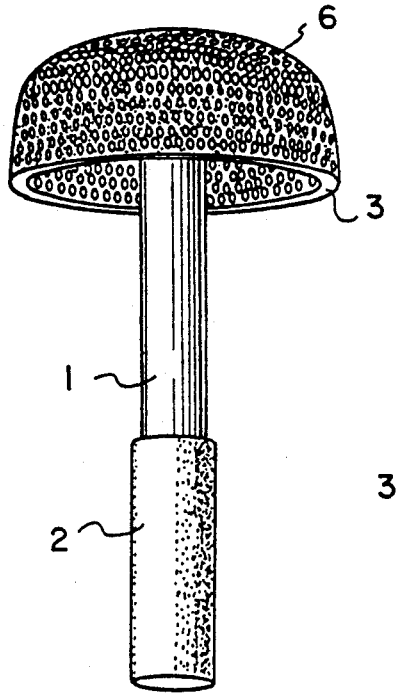
Fig. 2
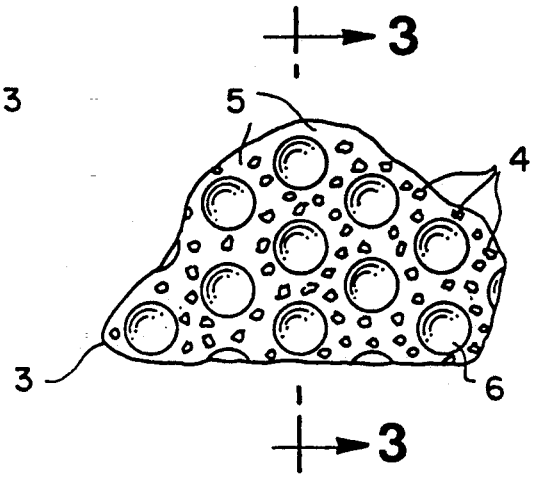
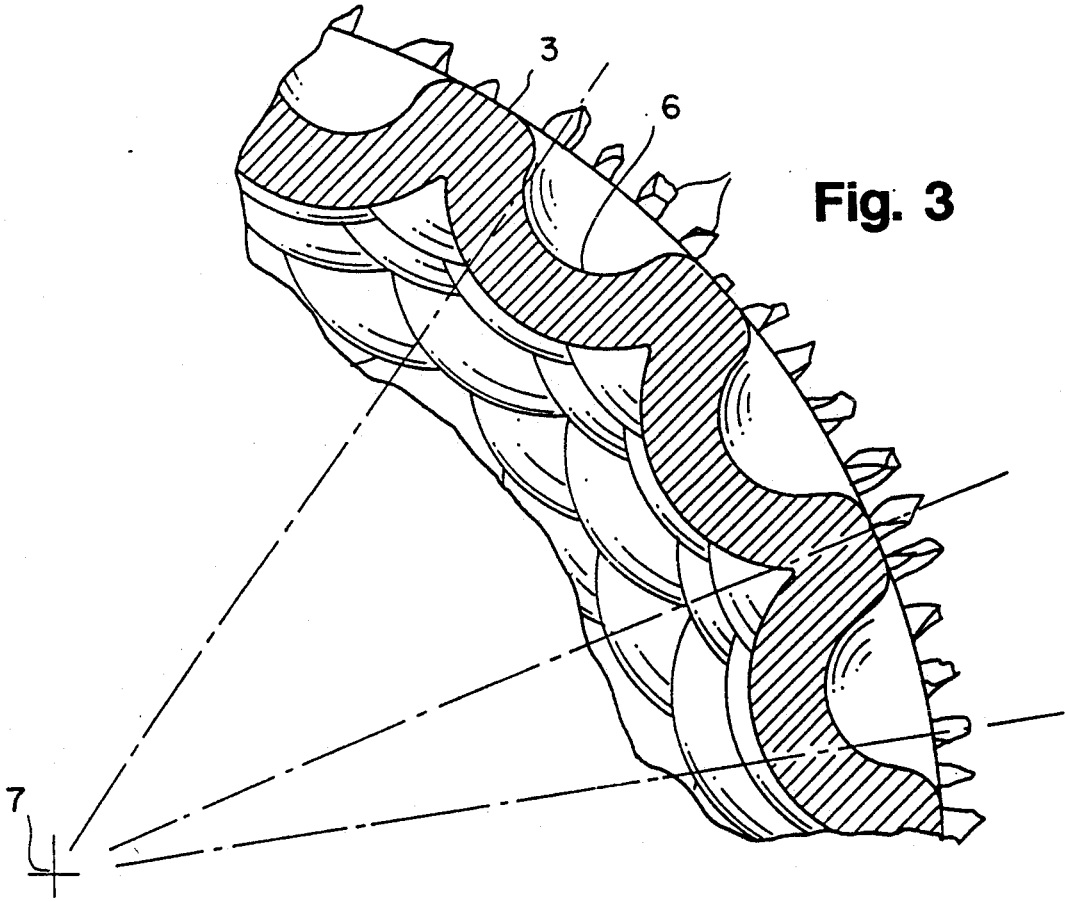
Fig. 3

CAVITIED ABRADING DEVICE WITH SMOOTH LANDS AREA AND LAYERED GRIT

This is a continuation-in-part of copending application Ser. No. 07/511,393 filed on Apr. 18, 1990, now abandoned.

BACKGROUND OF THE INVENTION

This invention relates generally to a rotating abrasive wheel for use in abrading various types of materials. More particularly, the invention utilizes crushed, sintered refractory metal grits such as sintered tungsten carbides and like hard particle substances which can be braze metal joined (or joined by other means) to a supporting base member.

It is well known in the prior art to magnetically orient individual metal grits on a spherical metal surface. In such applications, metal grits have been used in which substantially all of the grit had a typical length exceeding their smallest cross section. Then, by subjecting the metal surface to a magnetic field, the grit could be magnetically oriented into an abrading surface whereby substantially all of the grits' longest axes extended generally radially out from the curved metal surface. Such prior art devices utilized protrusions or protuberances of a predetermined size and configuration. These protuberances were applied to, or formed from, the metal base member, and the protuberances were then armed with metal grit. The grit was then brazed to the periphery of the protuberances. [See, for example, the process described in U.S. Pat. No. 3,918,217 to Oliver (the "Oliver patent").]

These prior art devices have several disadvantages. First, the protuberances or protrusions are subject to fracture or breakage, due to the substantial lateral forces applied when the abrasive wheel is in use. Second, the utilization of grit whose length exceeds its smallest cross section, together with the use of protrusions on the base member which, in the presence of a magnetic field, cause the metallic grit to orient itself so that it extends radially outward from the point the magnet is applied, causes another disadvantage: the placement of this longer grit with its radially outward orientation on the protrusions encourages fracturing and breakage of the grit. Further, the radially outward orientation ensures that only a single layer of grit can be applied to the protrusions on the base member. Thus, when one area or layer of grit is worn or broken away no other layer is exposed to take its place. Third, the existence of protrusions on the base member surface causes the abraded shavings to become trapped and load up on the protrusions. This also has important heat dissipation consequences, as discussed below. Finally, the magnetic field causes the metal grit to bunch up on the outermost periphery of each protuberance, with no grit occupying the smooth areas located between the protuberances of the base member. This particular grit formation exposes the grit to fracturing, further prevents the "layering" effect discussed below, and reduces the useful life of the tool.

SUMMARY OF THE INVENTION

The present invention is directed to an abrasive wheel for use in the abrading of various materials. This tool maintains all the advantages of the prior art devices, while providing enhanced performance and a longer useful life.

One object, therefore, of the present invention is to provide a generally uniform and layered distribution of small metal grit over the smooth land area of the abrasive wheel which will allow the cutting surface of the abrasive wheel to achieve a longer useful life.

A second object of the present invention is to allow for a more aggressive cutting action of the wheel by providing for improved removal of abraded material from the cutting surface of the wheel.

A third object of the present invention is to impart an enhanced cutting ability to a wheel while employing a smaller abrasive particle size, resulting in a finer texture left on the work piece.

A fourth object of the present invention is to provide a cutting tool which runs cooler and more efficiently than prior art devices through improved heat distribution from contact to noncontact surfaces, as well as a lowered torque due to a shortened extension of the grit particles from the metal surface.

A fifth object of the present invention is to provide a cutting tool which is more economical to manufacture.

A sixth object cf the present invention is to provide a base member structure for use with an abrading wheel which, when a magnetic field is applied, will allow metallic grit to orient itself into a position which, after brazing of the grit, will provide an efficient cutting tool having an interleaved grit structure.

These objects are achieved, at least in part, by the addition of cavities or recesses—instead of protuberances—which are distributed along a metal surface. When a magnetic field is applied to this novel configuration of the metal surface, the metal grit is caused to generally uniformly distribute itself along the smooth lands area of the metal surface, leaving the cavities free of grit.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures, and in which:

FIG. 1 is a side view of one type of abrasive wheel, commonly referred to as a "contour wheel", showing the metal base member, and the supporting base member with the sintered metal grit distributed generally uniformly along the surface.

FIG. 2 is a close-up view of the surface of the supporting base member, showing the sintered metal grit on the lands, as well as the concavities void of metal grit.

FIG. 3 is a cross sectional view of the supporting base member and grit protrusions.

DETAILED DESCRIPTION OF THE INVENTION

Figure 4:
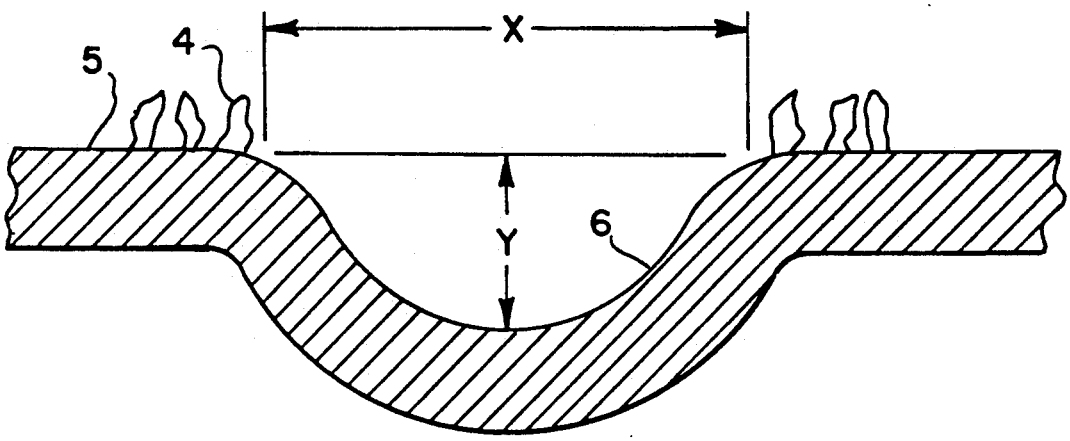
FIG. 4 is a side view of a representative cavity on the base member.

Referring to the drawings in greater detail, the finished tool, with metal base member 1, handle 2, and supporting base member 3, is shown in FIG. 1. It should be noted that the abrasive wheel illustrated in FIG. 1, known in the trade as a "contour wheel", is only one embodiment of the present invention. Those skilled in the art will understand that a variety of wheel shapes, e.g., conical or cylindrical, can be employed. While wheel circumferences of between two and eight inches are common, those skilled in the art will recognize that applications involving wheel circumferences of any size can be used.

Referring now to FIG. 2, the generally uniform distribution of metal grit 4 over the smooth portion or "lands" area 5 of supporting base member 3 is illustrated. Note that, due to the application of the magnetic field and its effect on positioning the metallic grit, no grit occupies the cavities 6 on base member 3. FIG. 3 illustrates the disposition of the magnetized, metal grit 4. The grit is not confined to extending radially outward from a center point, but rather forms interconnected layers of vertically and horizontally positioned grit. When a small grit particle breaks away, this layered effect enables another grit particle to be exposed.

Referring back to FIG. 1, the present invention teaches the use of cavities or recesses distributed either uniformly or nonuniformly along the supporting base member 3; the periphery of these cavities faces the metal base member 1. Each cavity is formed of a continuous, generally concave recess on the periphery of the base member (i.e., the work piece portion of the base member). These cavities may be of any convenient shape, e.g., round, square, etc. The spacing of the cavities can be varied to conform with the desired action of the wheel and the size of the abrasive material to be applied. The cavities may be spaced in straight rows or staggered in any number of design combinations. It can be appreciated by those skilled in the art that the size and spacing of the cavities can be changed to achieve an abrasive wheel with a wide operating range. Such a range allows, for example, for variances in the size of the abrasive material or the given cutting area an operator has to work with. In addition, the cavities provide an important structural advantage which further enhances the cutting ability of the wheel. The material removed by the wheel has the free area in the cavities to retreat to. At the point of contact with the wheel, portions of the abraded material are displaced within the individual cavities. As the high speed abrasive wheel rotates, the abraded material is expelled from the cavities by centrifugal force. In contrast, removed material in prior art devices tended to become trapped and load up on the abrasive protrusions, reducing the wheel's cutting ability. Further, some conventional wheels had holes on their outer working surface. Such configurations not only physically reduce the strength of the wheel, but also allow the abraded material to pass through the holes and build up on the inner surface of the wheel, causing the holes to close. Further, it has been found that a magnetic field applied to a wheel with holes causes the grit to lie flat and ineffectual upon the metal surface. The cavities of the present invention allow for a more aggressive cutting action of the wheel by ameliorating the effect of abraded material build-up.

With the supporting base member 3 constructed as shown in FIG. 1, a magnetic field and then sintered metal grit are applied, with the result that the metal grit positions itself as shown in FIG. 3: metal grit is generally uniformly distributed over the land area of the supporting base member, but not on the inner surface of the cavities. The prior art (specifically Oliver), in contrast, teaches the formation of bunched grit on the outermost periphery of the protuberances, and not on the lands area between the protuberances. This is due to the fact that the metal grit, as a result of magnetic flux lines which naturally concentrate in areas of discontinuity, is forced to points on the external metal surface (the protrusions) that exhibit rapid contour changes. Additionally, smaller metal grit can be utilized than that of the prior art, as the grit of the present invention need not be selected such that its length exceeds its smallest cross section. These smaller size particles impart an enhanced cutting ability to the wheel, as the resulting decreased cutting clearance makes the wheel easier to control, and leaves a finer texture on the work piece. Also, the longer particles of the prior art are more subject to fracturing and breakage.

The layered, interconnected grit of the present invention imparts a longer useful life to the abrasive wheel for three reasons. First, the layered configuration insures that when one piece of grit breaks away, another grit particle below it will be exposed for cutting. Second, the dimpled effect on the supporting base member allows the tool to run cooler and more efficiently. This is due to the fact that the inner surface of a wheel with recesses encompasses a greater surface area than a smooth surface. This increased surface area provides enhanced heat transfer capabilities to the metal surface, and thus improves heat dissipation as the wheel is used. Third, the smaller grit extends a shorter distance from the supporting base member than prior art tools. This shortened distance lowers the torque and thus the force applied to individual grit particles, which decreases the energy required to do work. More total work is accomplished, however, due to the increased number of smaller grit particles.

The heat transfer capabilities of the present invention, referred to above, are novel for another reason as well. As can be seen from FIG. 3, the distal portions of the grit particles overhang individual cavities. This novel structuring allows the individual cavities to act as natural heat sinks: the heat from the grit particles is transferred from the distal ends of the grit to the cavities, and the rotation of the wheel then cools both the inner and outer surfaces of the recesses.

Turning now to the dimensional significance of various elements of a preferred embodiment of the present invention, and referring specifically to the cavity or dimple pictured in FIG. 4, it has been found that the dimension "X," the length of a particular cavity, should preferably be at least twice the size of the longest axis possessed by a substantial portion of the grit particles to be applied to the base member. However, the dimension "X" should preferably not be greater than 3% of the circumference of the abrading wheel.

Still with reference to FIG. 4, it has been found that the dimension "Y," the height of a particular cavity, should be at least one-quarter of "X," but not more than three-quarters of "X."

Figure 5:
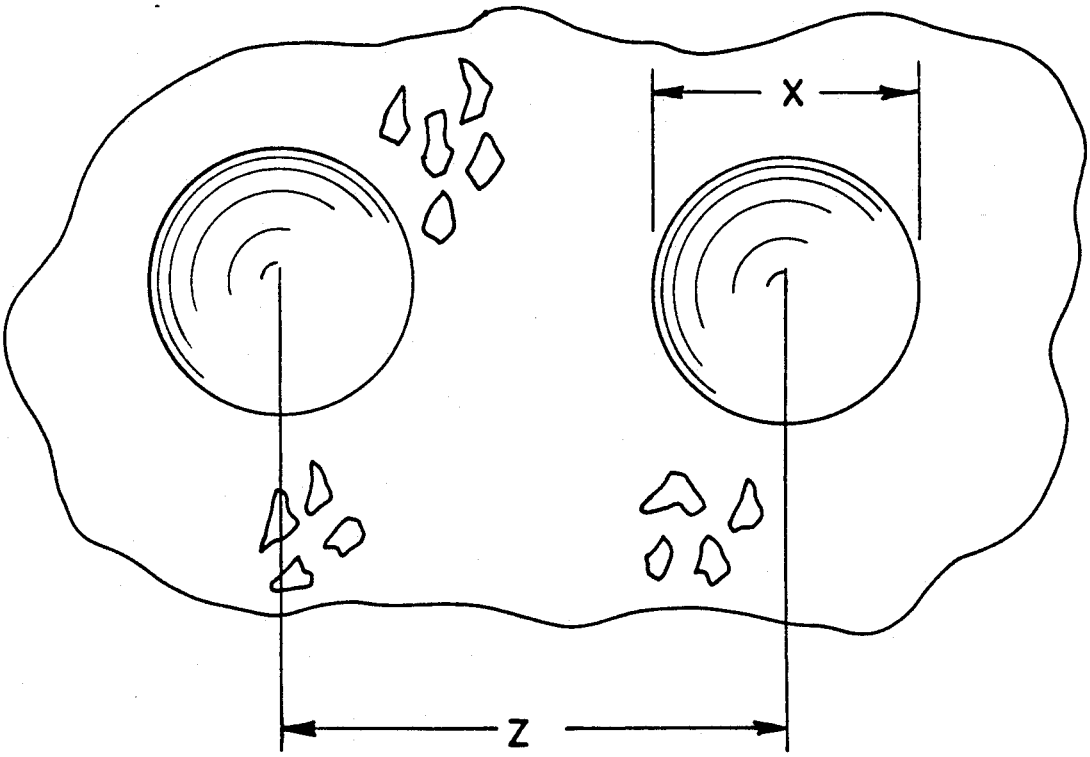
FIG. 5 is a plan view of two representative cavities on the base member.

Referring now to FIG. 5, it has also been found that the distance "Z" between the centerline of adjacent cavities should be greater than "X" (i.e., the cavities should not be contiguous), but "Z" should not be greater than 4X. Further, it is preferred that the dimple pattern be symmetrical or uniform about the base member, since a uniform pattern will aid in the dispersion of heat and abraded shavings, while ensuring a uniform distribution of interleaved grit about the smooth and continuous lands portion on the outer periphery of the base members.

The present invention also allows for more economical manufacture of these abrading tools. This economy is achieved through the previously described more efficient utilization of smaller abrasive particles than conventional wheels.

In a preferred embodiment of this invention, the metal grit consists of sintered tungsten carbides which can be braze metal joined (or joined by other means) to the supporting base member. The supporting base member is usually constructed out of a mild steel or other iron base alloy which has a high enough melting temperature beyond that of the brazing metal used to bond the various constituents of the finally processed device. (See U.S. Pat. No. 3,918,217, which is hereby incorporated by reference into this application.)

What is claimed is:

1. An abrading tool which provides for the aggressive removal of material from a body, the tool having a work surface driven in rotation about an axis and subjecting the body to a rotary abrading action, comprising:

a base member made of a ferrous or ferrous metal alloy whose outer periphery defines the work surface, said base member including a plurality of cavities positioned about the work surface, each of said cavities being separated by a generally continuous external lands area, wherein each of said cavities is formed of a continuous, generally concave recess and has a substantially uniform shape, and the surface length of said uniform cavities is at least twice the size of the longest axis possessed by a substantial portion of said metallic grit, but less than 3% of the circumference of the circular work surface; and a plurality of metallic grit layers being distributed on said lands area only, said metallic grit being applied after first subjecting said base member to a magnetic field.

2. An abrading tool which provides for the aggressive removal of material from a body, the tool having a work surface driven in rotation about an axis and subjecting the body to a rotary abrading action, comprising:

a base member made of a ferrous or ferrous metal alloy whose outer periphery defines the work surface, said base member including a plurality of cavities positioned about the work surface, each of said cavities being separated by a generally continuous external lands area, wherein each of said cavities is formed of a continuous, generally concave recess and has a substantially uniform shape, and the height of said uniform cavities is greater than 25% of the surface length of said uniform cavities, but less than 75% of the surface length of said uniform cavities; and a plurality of metallic grit layers being distributed on said lands area only, said metallic grit being applied after first subjecting said base member to a magnetic field.

3. An abrading tool which has a work surface driven in rotation about an axis and which provides for the aggressive removal of material from the body by subjecting the body to the rotary abrading action of the tool, comprising:

a plurality of metallic grit layers;

a base member made of a ferrous or ferrous metal alloy whose outer periphery defines a circular work surface, said base member including a plurality of uniformly-shaped cavities positioned about the work surface, each of said cavities being separated by a generally continuous external lands area; the surface length of said cavities being at least twice the size of the longest axis possessed by a substantial portion of said metallic grit, but less than 3% of the circumference of said circular work surface; the height of said uniform cavities being greater than 25% but less than 75% of the surface length of said uniform cavities; and the distance between the centerline of adjacent cavities being greater than the surface length of each of said cavities, but not greater than four times the surface length of each of said cavities;

said plurality of metallic grit layers being distributed about said land area whereby, upon the application of a magnetic field, the particular magnetic flux resulting from said plurality of cavities on said work surface of said base member causes said metallic grit to orient itself into a layered fashion over said external lands area only such that, when said metallic grit is then braced directly to said lands area, said lands area is continuously covered with said metallic grit.

* * * * *